US006885812B2

(12) United States Patent
Groom

(10) Patent No.: US 6,885,812 B2
(45) Date of Patent: Apr. 26, 2005

(54) SYSTEM AND METHOD FOR HEATING SOLID OR VAPOR SOURCE VESSELS AND FLOW PATHS

(75) Inventor: Richard C. Groom, Round Rock, TX (US)

(73) Assignee: MKS Instruments, Inc., Wilmington, MA (US)

( * ) Notice: Subject to any disclaimer, the term of this patent is extended or adjusted under 35 U.S.C. 154(b) by 57 days.

(21) Appl. No.: 10/382,599

(22) Filed: Mar. 6, 2003

(65) Prior Publication Data

US 2004/0175160 A1 Sep. 9, 2004

(51) Int. Cl.[7] ..... F22B 29/06
(52) U.S. Cl. ..... 392/397; 392/485
(58) Field of Search ..... 392/386, 394, 392/396, 397, 398, 478, 479, 480, 482, 483, 484, 488, 489; 219/535, 528, 548, 549, 212; 164/421; 29/890.32; 285/41, 65, 70, 417

(56) References Cited

U.S. PATENT DOCUMENTS

| | | | | |
|---|---|---|---|---|
| 5,714,738 A | | 2/1998 | Hauschulz et al. | |
| 5,832,177 A | * | 11/1998 | Shinagawa et al. | 392/394 |
| 5,849,454 A | * | 12/1998 | Tada et al. | 430/127 |
| 5,883,364 A | * | 3/1999 | Frei et al. | 219/535 |
| 6,143,084 A | * | 11/2000 | Li et al. | 118/723 IR |
| 6,220,302 B1 | * | 4/2001 | Nolley | 138/99 |
| 6,338,312 B1 | * | 1/2002 | Hayes et al. | 118/723 CB |

OTHER PUBLICATIONS

E. Boshek, J. Schwartz, *Impact of Gas Panel Components on SDS® Gas Utilization,* 4 pages.
European Semiconductor, *Optimised MFCs make SDS economic,* Mar. 2000, 2 pages.
Matheson Tri–Gas, *Hydrogen Selenide SDS2® Safe Delivery Source,* 1998, 2 Pages.
Watlow Electric Manufacturing Company, *Series 93, A Reliable Tool For All Basic Temperature Control Applications,* 2000, 4 Pages.
MKS Instruments, Vacuum Products Group, *Jalapeno Series Heated Vacuum Valves for Semiconductor Processes,* 2000, 12 Pages.
MKS Instruments, Vacuum Products Group, *Series 45 HPS Heaters Sizes 1–1/2" to 4" (NW 40 to NW 100),* 2000, 16 Pages.

* cited by examiner

*Primary Examiner*—Sang Y. Paik
(74) *Attorney, Agent, or Firm*—McDermott Will & Emery LLP

(57) ABSTRACT

A system for heating a flow path including at least a solid or vapor source vessel connected by a conduit to a valve. The system includes at least one tubular adapter of heat conductive material for receipt along at least a portion of the flow path. The adapter has inner dimensions substantially corresponding to outer dimensions of the portion of the flow path and an outer dimension which is substantially constant along a length of the adapter. The system also includes at least one tubular heater apparatus received over the adapter and having an inner dimension that is substantially constant along a length of the heater apparatus and substantial corresponds to the outer dimension of the adapter.

25 Claims, 3 Drawing Sheets

SYSTEM AND METHOD FOR HEATING SOLID OR VAPOR SOURCE VESSELS AND FLOW PATHS

FIELD OF THE INVENTION

This invention relates generally to a flexible insulated heater for surrounding pipes or other odd shaped components that require heating and, more particularly, to adapters and flexible insulated heaters for heating objects possessing either two-dimensional curvature, such as piping and other conduits, or three-dimensional curvature, such as spheres, saddles, valve bodies, elbow fittings, or T-fittings. Even more particularly, the present invention is directed to a system and a method for providing a stable and uniform temperature to a solid or vapor source vessel and connecting flow path of an ion implanter.

BACKGROUND OF THE INVENTION

Heaters are often used in the semiconductor device manufacturing, chemical processing, plastics manufacturing, commercial food processing, equipment manufacturing, and other manufacturing industries to heat or insulate piping, tubing, valve bodies, and other conduits having two-dimensional or three-dimensional curvature, particularly if processing or manufacturing requires that liquids or gases be transported at specific temperatures with limited heating or cooling or to prevent solidification of vaporous materials and consequent deposition of such materials on inside surfaces of the piping, tubing, valve bodies, and other conduits. The heaters can be thermally insulated from the ambient air to reduce the amount of power required and to minimize the outside temperature of the exposed heaters so that personnel who might contact them do not become accidentally burned.

For example, semiconductor manufacturing processes, such as Low Pressure Chemical Vapor Deposition (LPCVD) and aluminum etching, generate reaction byproducts, such as ammonium chloride gas ($NH_4Cl$) or aluminum chloride ($AlCl_3$) gas, in the effluent gas created in and discharged from the reaction process chamber. The ammonium chloride gas may solidify, deposit, and thereby cause a solid buildup on any cool surface, such as the inside surface of an unheated pipe conveying the gas to an exhaust or disposal site, vacuum pumps, and other equipment. This solid buildup in pipes, pumps, and other equipment downstream from the reaction process chamber can partially or even entirely plug the pipes, damage the pumps and other equipment, reduce vacuum conductance, and render piping, pumps, and other equipment used in the manufacturing process functionally impaired or inoperative.

The solid buildup caused by cooling can also flake apart and off the piping surfaces so as to become sources of contamination in the manufacturing process. A Low Pressure Chemical Vapor Deposition (LPCVD) process for depositing a coating of silicon nitride on substrate wafers used to form semiconductor chips, for example, creates this type of solid buildup by producing large amounts of ammonium chloride gas as a byproduct in the reaction chamber where the silicon nitride deposition occurs. Ammonium chloride gas typically sublimates at a temperature of less than one hundred degrees Celsius (100° C.) at 300 millitorr. Once the ammonium chloride gas leaves the reaction chamber and cools down, sublimation of the ammonium chloride causes a white crystalline material to form and build up on all unheated surfaces, such as on the insides of pipes and pumps used in the manufacturing system. The sublimated ammonium chloride can flake, break away, and flow back into the reaction chamber, where it can contaminate the semiconductor substrate wafers in the reaction chamber. If such contamination occurs, the manufacturing system must be shut down while the crystalline material is cleaned out of the system, and the clogged pipes and pumps have to be cleaned or replaced. In addition, the substrate wafers or semiconductor chips may have become so contaminated that they are worthless and beyond repair or use. In order to prevent the ammonium chloride gas from solidifying and clogging or contaminating the manufacturing system, heaters can be placed around the piping to preclude the ammonium chloride gas from cooling, sublimating, solidifying, or condensing until it reaches an area where it can be collected effectively and efficiently.

The use of heaters and other devices to heat and/or insulate objects, including pipes in the exemplary setting described above, is well-known in the art. For example, HPS Division of MKS Instruments, Inc., the assignee of the present invention, and Watlow Electric, Inc., developed a heater structure primarily for heating pipe components, valve bodies, and the like for the semiconductor processing industry. Their VacuComp™ Series 43 Valve Heater Jackets, Flexible Section Heater Jackets, Straight Section Heater Jackets, and Bend Section Heater Jackets are examples of these pipe component heaters, which use a thin fiberglass reinforced silicone heater mat laid flat and cut into flat patterns that, when pulled up and forced into three dimensional curves, will conform to the three-dimensional shapes of pipe components for which they are patterned. Flat sheets of silicone foam rubber are also cut into somewhat the same shaped, but smaller patterns and are then bonded to an exposed flat surface of the heater mats for heat insulation, leaving uncovered edge sections of the heater mat extending laterally outward from the silicone foam rubber insulation sheets. Lace hooks and laces are attached to the uncovered edge sections of the heater for pulling and fastening the pipe heater structures into curved, three dimensional configurations around the valve bodies, flexible, curved, and straight pipe sections, and other pipe components for which they are patterned.

U.S. Pat. No. 5,714,738, which is assigned to both the HPS Division of MKS Instruments, Inc., the assignee of the present invention, and Watlow Electric, Inc., shows a flexible insulated heater including a heater mat surrounded by an insulation jacket. The heater mat is preferably made of two layers of fiberglass reinforced rubber sheets laminated together with resistive heater wires sandwiched between the laminated sheets. The heater mat is formed with a curvature and sized to fit snugly around the peripheral surface of the pipe that is to be heated. A jacket of thermally insulating material, such as a polymer foam, is molded over the external surface of the heater mat. The insulated jacket holds the heat generated by the heater mat from escaping radially outward, and it protects against burns to persons who might touch the heater. The mat and the jacket are configured so that the heater has interfacing opposite edges and that meet and preferably touch each other when the heater is mounted on the pipe, but the combination of the mat and jacket have sufficient resilient flexibility to allow opening the heater by separating the edges enough to slip the heater over the pipe, whereupon the heater resumes its original inherent cylindrical shape when released. Snaps, Velcro™ fastening material straps, or other suitable fasteners can be used to secure the heaters snugly around the pipe, if desired, although the biased resilience of the heater to its formed shape is generally sufficient itself to hold the heater in place. A power cord, control cavity, and an optional overmold provide electric power to the heating wires or elements in the heating mat. A system of flexible insulated heaters can be daisy-chained or ganged together to heat and insulate a network of pipes. Exemplary embodiments of the heaters disclosed in U.S. Pat. No. 5,714,738 are sold by the Vacuum Products Groups of MKS Instruments, Inc. as Series 45 HPS™ heaters.

In semiconductor manufacturing, an ion beam implanter is used to alter the near surface properties of semiconductor materials. Solid or vapor source vessels are a method for the storage and safe delivery of arsine, phosphine, boron trifluoride, silicon tetrafluoride and germanium tetrafluoride for ion implantation. The solid or vapor source vessels allow gases to be delivered to the ion source region of an ion implanter with maximum gas vessel pressures of less than one atmosphere, eliminating the risks associated with the delivery of hazardous gases at higher pressures. The solid or vapor source vessel contains a solid material that absorbs a desired process gas and holds the gas at sub-atmospheric pressure levels. Previous methods for providing a source material include heating the material at high temperature in a crucible to produce a gas. The solid or vapor source vessels, however, are safer and provide a larger volume of useable material. SDS™ (Safe Delivery Source) brand vessels are an example of a solid or vapor source vessels.

In addition to providing heaters, MKS Instruments, Inc. also provides mass flow controllers. The Model M330 Mass Flow Controller (MFC), for example, has successfully been used with solid or vapor source vessels, such as the SDS™ brand vessels. The M330 was specifically designed to maintain the necessary flow control performance levels with an extremely low pressure drop across the MFC, allowing for more efficient use of solid source gas vessels. Phosphine, for example, can be effectively delivered at a rate of 0.8 sccm with an SDS™ gas vessel pressure as low as 1.5 Torr and 1 Torr at 0.5 sccm in an Acelis model GSD ion implanter. The low gas vessel operating pressures allow for a higher percent of the source gases to be used before refilling is necessary, reducing operating costs and increasing implanter system availability. The MKS M330 allows over 97% of the solid source vessel contents to be utilized for gas delivery.

What is further desired, however, are a new and improved system and method for heating solid or vapor source vessels and flow paths. Preferably, a new and improved system and method for providing stable and uniform heating of solid source vessels and flow paths that are substantially free of cold spots.

SUMMARY OF THE INVENTION

The present invention provides a new and improved system for heating a flow path including at least a solid or vapor source vessel connected by a conduit to a valve. The system includes at least one tubular adapter of heat conductive material for receipt along at least a portion of the flow path. The adapter has inner dimensions substantially corresponding to outer dimensions of the portion of the flow path and an outer dimension which is substantially constant along a length of the adapter. The system also includes at least one tubular heater apparatus received over the adapter and having an inner dimension which is substantially constant along a length of the heater apparatus and substantial corresponds to the outer dimension of the adapter.

Among other aspects and advantages, the present invention provides a new and improved system and method for heating solid or vapor source vessels and flow paths for ion implanters. The solid or vapor source vessel is preferable to other existing methods, such as a heated crucible, for providing gaseous source material, such as antimony, to an ion implanter because the solid or vapor source vessel is safer and provides a greater amount of source material. The new and improved system and method for heating in turn provides stable and uniform heating of solid or vapor source vessels and flow paths that are substantially free of cold spots.

Additional aspects and advantages of the present invention will become readily apparent to those skilled in this art from the following detailed description, wherein exemplary embodiments of the present invention are shown and described, simply by way of illustration of the best modes contemplated for carrying out the present invention. As will be realized, the present invention is capable of other and different embodiments and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference character designations represent like elements throughout, and wherein.

DETAILED DESCRIPTION OF EXEMPLARY EMBODIMENTS

Figure 1:
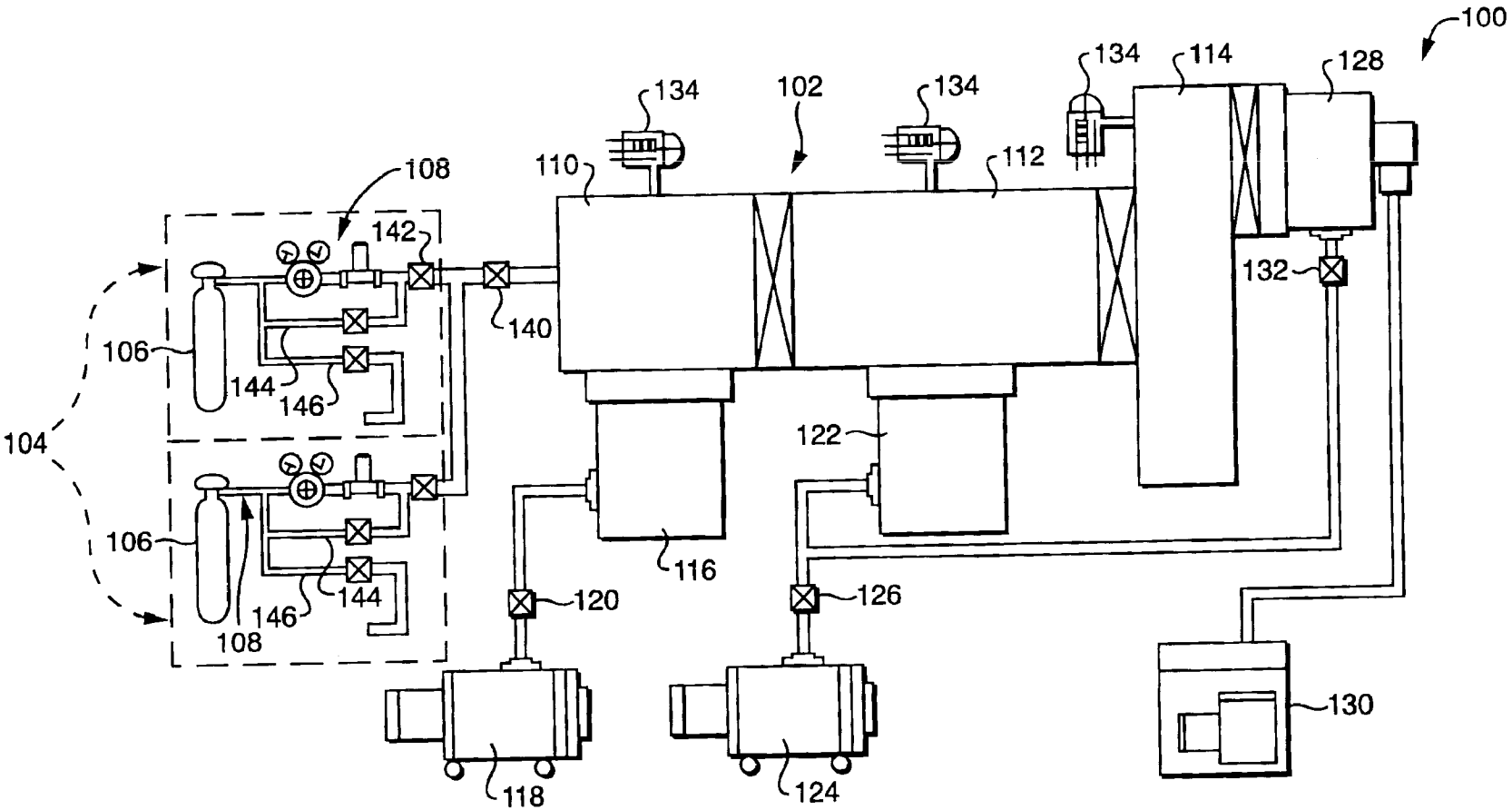
FIG. 1 is a schematic illustration showing a block diagram of an exemplary embodiment of an existing high vacuum system including an ion implanter having an solid or vapor source vessel and connecting flow path.

Referring to FIG. 1, a block diagram of an exemplary embodiment of a high vacuum system 100 including an ion implanter 102 and one or more sets 104 of solid or vapor source vessels 106 and connecting flow paths 108 is shown. The ion implanter 102 requires the high vacuum system 100 in order to generate a plasma and transport an ion beam from an ion source housing 110 through an analyzer magnet in a beamline housing 112 to a connected process chamber 114 (where a work piece receives the ion implantation). The solid or vapor source vessels 106 supply the gases to be ionized by the ion implanter 102.

In the exemplary embodiment shown, the high vacuum system 100 includes a turbomolecular pump 116 connecting the source housing 110 of the ion implanter 102 to a dry roughing pump 118 through an isolation valve 120 (the turbomolecular pump 116 cannot exhaust to atmosphere and requires the primary, or roughing pump 118 to reduce the pressure in the system to before the pump 116 can start). A turbomolecular pump 122 connects the beamline housing 112 of the ion implanter 102 to a dry roughing pump 124 through an isolation valve 126. A cryopump 128 having a cryocompressor 130 connects the process chamber 114 to the dry roughing pump 124 through an isolation valve 132 (the cryopump is a capture-type vacuum pump that evacuates the chamber 114 by freezing and retaining the gases from the chamber). The ion implanter 102 also includes measurement devices such as ion gages 134 connected to the source housing 110, the beamline housing 112, and the process chamber 114.

The ion implanter 102 can comprise, for example, an Acelis model GSD ion implanter. The ion implantation process is widely used in the semiconductor industry. In this method, impurities such as antimony (Sb), indium (In), arsenic (As), phosphorous (P), boron (B), etc. are ionized then an accelerating column propels these ions to implant the wafers. The wafers show N-type (As, P) or P-type (B) electrical characteristics, depending on the impurities implanted. Specialty gases such as arsine ($AsH_3$), phosphine ($PH_3$) and boron trifluoride ($BF_3$), and solid substances such as metallic arsenic and red phosphorus are used as impurity sources. Although gases are easy to handle, there is a risk of accidental explosion because gases are supplied under high pressure, whereas with solid substances, there is no risk of explosion. They do, however, require special care for the heating and cleaning of the equipment.

In the exemplary embodiment of FIG. 1, the high vacuum system 100 includes two of the sets 104 of sources vessels 106 and connecting flow paths 108 connected to the ion implanter 102 through a primary isolation valve 140. Each set 104 includes the solid or vapor source vessel 106 connected through the primary flow path 108 and a secondary isolation valve 142 to the primary isolation valve 140 of the ion implanter 102. Each set also includes a bypass flow path 144 and a purge flow path 146, as shown. The solid or vapor source vessels can comprise, for example, SDS™ (Safe Delivery Systems) brand solid or vapor source vessels 106, which are available from Matheson Tri-Gas (www.matheson-trigas.com).

The solid or vapor source vessels incorporate adsorbent agents, such as decaborane, inside the vessels, making it possible to fill impurities such as antimony and indium under atmospheric pressure. This feature allows for better gas handling safety and higher cost-performance than gaseous and solid substances, which are highly evaluated by the world's semiconductor manufacturers, such that the solid or vapor source vessels are now regarded as the world's de facto standard for ion implantation sources.

Features of the solid or vapor source vessels are inclusion of gas adsorbent agents inside the vessel to adsorb ion source gases to keep the inside pressure of the vessel lower than the atmospheric pressure. This system supplies gases using the difference between the inside pressure of the solid or vapor source vessels 106 and the ion implantation equipment 102 (high vacuum). Therefore, safe gas delivery and cost cutting are accomplished through an improved rate of operation when supplying dopant gases such as antimony, indium, arsine, phosphine and boron trifluoride gases. As the amount of gas contained in the vessel is 14 to 40 times higher than those contained in the conventional high-pressured gas vessels, there is no need to replace the vessels frequently due to the improvement of vessel's construction and this allows the users to cut costs. Solid or vapor source vessels also provide a greater supply and are safer to operate that heating source material at temperature greater than 500° C. in a crucible.

Figure 3:
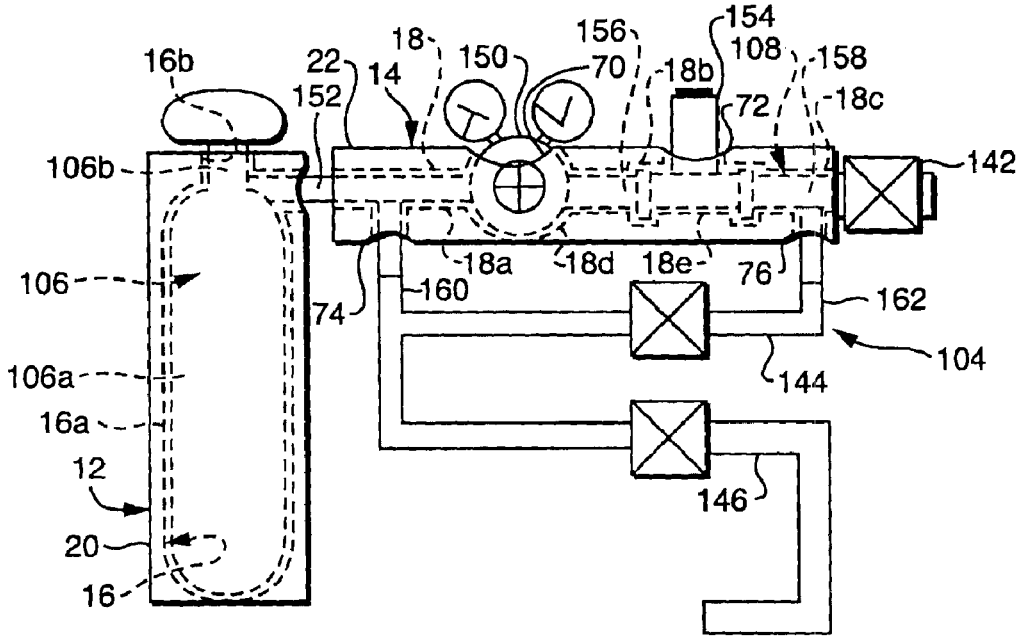
FIG. 3 is an enlarged view of the solid or vapor source vessel and connecting flow path of the valve assembly of FIG. 1 and the adapters of FIG. 2, shown with the heater apparatuses of the heating system of the present invention removed.
Figure 4:
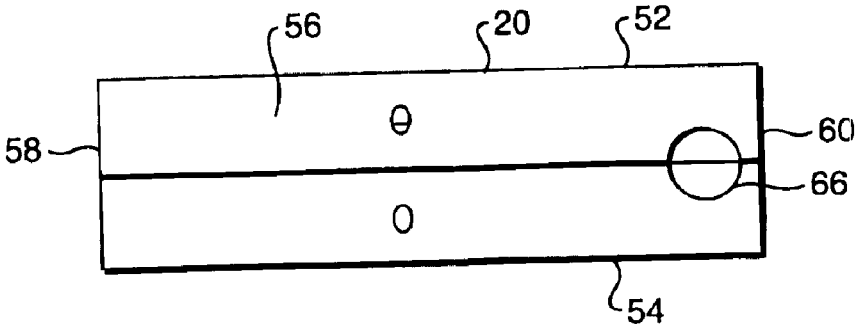
FIG. 4 is an enlarged side elevation view of a first of the adapters of FIG. 2.
Figure 5:
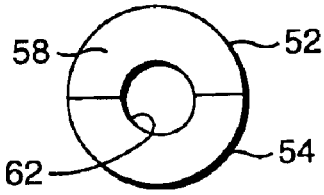
FIG. 5 is an enlarged end elevation view of the first of the adapters of FIG. 2.
Figure 6:
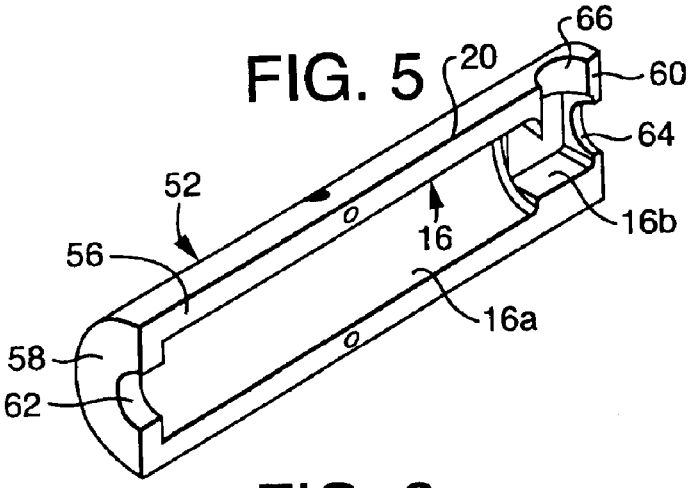
FIG. 6 is an enlarged perspective view of one of two identical portions of the first of the adapters of FIG. 2.
Figure 7:
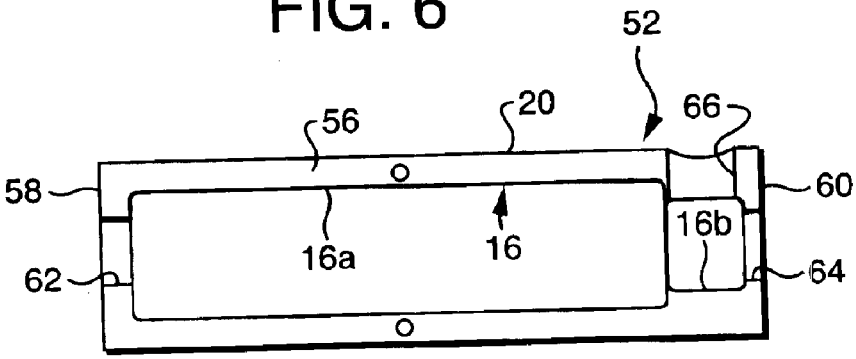
FIG. 7 is an enlarged side elevation view of the portion of FIG. 6.

As shown in FIGS. 3 and 4, the flow paths 108 each include a pressure sensor 150 connected through a first conduit 152 to the solid or vapor source vessel 106, and the pressure sensor 150 is connected to a mass flow controller 154 through a second conduit 156. The mass flow controller 154, in turn, is connected to the isolation valve 142 through a third conduit 158. In one exemplary embodiment, the mass flow controller 154 comprises an MKS Instruments, Inc. model M330 mass flow controller. Conduits 160, 162 connect the flow path 108 to the bypass flow path 144 and the purge flow path 146.

Figure 2:
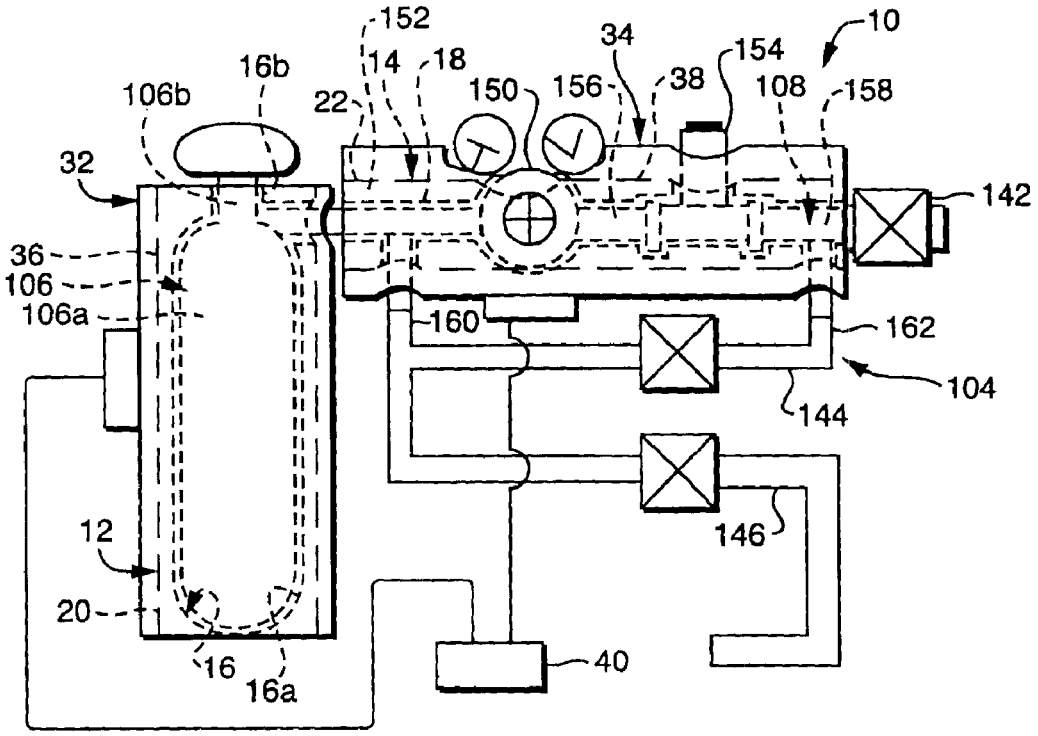
FIG. 2 is an enlarged view of the solid or vapor source vessel and connecting flow path of the valve assembly of FIG. 1 covered by an exemplary embodiment of a heating system constructed in accordance with the present invention and including exemplary embodiments of tubular adapters covering the solid or vapor source vessel and the connecting flow path, and tubular heater apparatuses covering the adapters.

Referring now to FIG. 2, the present invention provides a new and improved system 10 and method for heating the solid or vapor source vessels 106 and the flow paths 108. The new and improved system 10 and method provides a stable and uniform heating of the solid or vapor source vessels 106 and the flow paths 108 that is substantially free of cold spots.

In general, the heating system 10 includes at least one tubular adapter 12, 14 of heat conductive material for receipt along at least a portion of the solid or vapor source vessel 106 and the flow path 108. In the exemplary embodiment shown, the heating system 10 includes two adapters 12, 14. A first of the adapters 12 is received over the solid or vapor source vessel 106, while a second of the adapters 14 is received over the flow path 108. The first adapter 12 has inner dimensions 16 substantially corresponding to outer dimensions of the solid or vapor source vessel 106, while the second adapter 14 has inner dimensions 18 substantially corresponding to outer dimensions of the flow path 108. Thus, the inner surfaces of the adapters 12, 24 are adapted, sized and shaped to match an outer profile of the solid or vapor source vessel 106 and the flow path 108. Each tubular adapter 12, 14 also includes an outer dimension 20, 22, respectively, which is substantially constant along a length of the adapter, so that the combination of the adapters 12, 14 mounted on the solid or vapor source vessel 106 and the flow path 108 provide an outer surface having consistent dimension for tubular heater apparatuses 32, 34 received over the adapters 12, 14.

The system 10 also includes the tubular heater apparatuses 32, 34 received over the adapters 12, 14. Each heater apparatus 32, 34 has an inner dimension 36, 38, respectively, which is substantially constant along a length of the heater apparatus and substantial corresponds, respectively, to the outer dimensions 20, 22 of the adapters 12, 14. Since the heater apparatuses 32, 34 have consistent inner dimensions 36, 38, they are not required to be customized to fit tightly along the solid or vapor source vessel 106 and the flow path 108, such that heater apparatuses 32, 34 having standard, consistent dimensions can be employed by the heating system 10. Instead, the adapters 12, 14, which are cheaper and easier to manufacture than the heater apparatuses 32, 34, are customized to tightly fit and encapsulate the solid or vapor source vessel 106 and the flow path 108. The customized heat conductive adapters 12, 14 in combination with the standardized, "off-the-shelf" heater apparatuses 32, 34, produce a uniform heating of the solid or vapor source vessel 106 and the flow path 108 free of cold spots.

Exemplary embodiments of heater apparatuses for use as part of the present invention include those disclosed in U.S.

Pat. No. 5,714,738, and that are sold by the Vacuum Products Groups of MKS Instruments, Inc. as Series 45 HPS™ heaters. U.S. Pat. No. 5,714,738 is assigned to the assignee of the present invention and is incorporated herein by reference. Although not shown in detail, the heater apparatuses 32, 34 can each include a heater mat received over the adapters 12, 14. The heater mats, as disclosed in detail in U.S. Pat. No. 5,714,738, have an electric heating element sandwiched between two sheets of thin, flexible and substantially unstretcheable material. The heater mat can be less than two millimeters thick, and the two sheets of thin, flexible and substantially unstretcheable material of the heater mat can comprise fiberglass reinforced silicone solid rubber. Although not shown, the heater apparatuses 32, 34 also can each include an insulative jacket molded over the heater mat, as disclosed in detail in U.S. Pat. No. 5,714,738. The insulative jacket is adapted to compressively deform under external force but resiliently bias the heater mat back into its original shape and size when the external force is removed. The insulative jacket comprises one of silicone sponge and foam rubber, and has a thickness of at least 0.25 inches. The heater apparatuses 32, 34 can further include fasteners, such as snaps or Velcro™ fastening material straps, for securing the heater apparatuses around the adapters 12, 14.

As shown in FIG. 2, the heater system 10 also includes a controller 40 for controlling the temperatures of the heater apparatuses 32, 34. According to one exemplary embodiment, the controller 40 comprises one of a Watlow Series 93 controller and a Watlow Type 935 controller, which are available from Watlow Electric Manufacturing Company of St. Louis, Mo., although other types or brands of controllers can be used.

Each of the adapters 12, 14, which are also shown in FIG. 3, is comprised of a metal, such as aluminum. In the exemplary embodiments shown, the tubular adapters 12, 14 each have a circular cross section so that the outer dimensions comprise outer diameters. In the exemplary embodiment of the first adapter 12, which is also shown in FIGS. 4 through 7, the adapter 12 includes two pieces 52, 54 secured together around the solid or vapor source vessel with fasteners, such as dowel pins. The adapter 12 includes a side wall 56 extending between two end walls 58, 60, wherein each end wall 58, 60 includes an opening 62, 64 and the side wall 56 includes at least one opening 66. The inner dimensions 16 of the adapter 12 include a first inner dimension 16a sized and shaped to correspond to a body 106*a* of the solid or vapor source vessel 106, and a second inner dimension 16*b* sized and shaped to correspond to a neck 106*b* of the solid or vapor source vessel 106, as shown in FIG. 3.

As shown in FIG. 3, the inner dimensions 18 of the exemplary embodiment of the second adapter 14 includes a first inner dimension 18*a* sized and shaped to correspond to the first conduit 152 of the flow path 108, a second inner dimension 18*b* sized and shaped to correspond to the second conduit 156, a third inner dimension 18*c* sized and shaped to correspond to the third conduit 158, a fourth inner dimension 18*d* sized and shaped to correspond to the pressure sensor 150, and a fifth inner dimension 18*e* sized and shaped to correspond to the mass flow controller 154. The second adapter 14 also includes, in its side wall, an opening 70 for the pressure sensor 150, an opening 72 for the mass flow controller 154, and openings 74, 76 for the conduits 160, 162 connecting the flow path 108 to the bypass flow path 144 and the purge flow path 146. Each of the first and the second tubular adapters 12, 14 can be provided with a smallest thickness of at least 0.25 inches.

Thus, a new and improved heating system 10 constructed in accordance with the present invention has been described. In particular, the present invention provides a new and improved system and method for heating solid or vapor source vessels and flow paths. The new and improved system 10 and method in turn provides stable and uniform heating of solid or vapor source vessels and flow paths that are substantially free of cold spots.

The exemplary embodiments described in this specification have been presented by way of illustration rather than limitation, and various modifications, combinations and substitutions may be effected by those skilled in the art without departure either in spirit or scope from this invention in its broader aspects and as set forth in the appended claims. The heating system 10 of the present invention as disclosed herein, and all elements thereof, are contained within the scope of at least one of the following claims. No elements of the presently disclosed heating system are meant to be disclaimed.

What is claimed is:

1. A system for heating a flow path including at least a solid or vapor source vessel connected by a conduit to a valve, wherein outer cross-sectional dimensions of the flow path vary along a length of the flow path, comprising:

at least one tubular adapter comprising hear conductive material for receipt along the length of the flow path, the adapter having varying inner cross-sectional dimensions substantially corresponding to the varying outer cross-sectional dimensions of the flow path and an outer cross-sectional dimension which is substantially constant along a length of the adapter, wherein the substantially constant outer cross-sectional dimensions in combination with the varying inner cross-sectional dimensions of the adapter allows substantially uniform heating of the flow path that is substantially free of cold spots; and at least one tubular heater apparatus for heating the flow path received over the adapter and having an inner dimension which is substantially constant along a length of the heater apparatus and substantial corresponds to the outer dimension of the adapter.

2. A system according to claim 1, wherein the adapter is comprised of a metal.

3. A system according to claim 2, wherein the adapter is comprised of aluminum.

4. A system according to claim 1, wherein the adapter comprises at least two pieces secured together with fasteners.

5. A system according to claim 4, wherein the fasteners of the adapter comprise dowel pins.

6. A system according to claim 1, wherein the adapter includes a side wall extending between two end walls, wherein each end wall includes an opening and the side wall includes at least one opening.

7. A system according to claim 1, wherein the tubular adapter has circular cross sections so that the inner and the outer dimensions comprise inner and outer diameters.

8. A system according to claim 2, wherein the tubular adapter has a thickness of at least 0.25 inches.

9. A system according to claim 1, wherein the heater apparatus comprises:

a heater mat received over the adapter and having an electric heating element sandwiched between two sheets of thin, flexible and substantially unstretcheable material; and an insulative jacket molded over the heater mat.

10. A system according to claim 9, wherein the insulative jacket is adapted to compressively deform under external force but resiliently bias the heater mat back into its original shape end size when the external force is removed.

11. A system according to claim 9, wherein the insulative jacket comprises one of silicone sponge and foam rubber.

12. A system according to claim 9, wherein the insulative jacket has a thickness of at least 0.25 inches.

13. A system according to claim 9, wherein the heater mat is less than two millimeters thick.

14. A system according to claim 9, wherein the two sheets of thin, flexible and substantially unstretcheable material of the heater mat comprise fiberglass reinforced silicone solid rubber.

15. A system according to claim 1, wherein the heater apparatus further comprises fasteners for securing the heater apparatus around the adapter.

16. A system according to claim 1, wherein the heater apparatus comprises a Series 45 HPS™ heater.

17. A system according to claim 1, wherein the heater apparatus further comprises a controller for controlling the temperature of the heater apparatus.

18. A system according to claim 17, wherein the controller of the heater apparatus comprises one of a Watlow Series 93 controller and a Watlow Type 935 controller.

19. A flow path assembly including the system of claim 1 and further comprising a flow path including at least one of a solid or vapor source vessel connected by at least one conduit to a valve, and wherein the adapter is received over at least a portion of the flow path, and the heater apparatus is received over the adapter.

20. A flow path assembly according to claim 19, wherein the flow path includes the solid or vapor source vessel connected to a pressure sensor through a first of the conduits and the pressure sensor is connected to a mass flow controller through a second of the conduits and the mass flow controller is connected to the valve through a third of the conduits.

21. A flow path assembly according to claim 20, wherein the mass flow controller comprises an MKS Instruments, Inc. model M330 mass flow controller.

22. A flow path assembly according to claim 20, wherein the solid or vapor source vessel comprises an SDS™ solid or vapor source vessel.

23. A flow path assembly according to claim 20, wherein the solid or vapor source vessel contains antimony.

24. An ion implanter including the flow path assembly of claim 20.

25. An ion implanter according to claim 24 wherein the ion implanter comprises an Acelis model GSD ion implanter.

* * * * *

UNITED STATES PATENT AND TRADEMARK OFFICE

CERTIFICATE OF CORRECTION

PATENT NO. : 6,885,812 B2
DATED : April 26, 2005
INVENTOR(S) : Groom

It is certified that error appears in the above-identified patent and that said Letters Patent is hereby corrected as shown below:

Column 8,
Line 25, after "comprising" and before "conductive", delete "hear", and insert thereof -- heat --; and Column 9,
Line 4, after "shape" and before "size", delete "end", and insert thereof -- and --.

Signed and Sealed this

Twelfth Day of July, 2005

JON W. DUDAS
*Director of the United States Patent and Trademark Office*